United States Patent [19]

Stein

[11] 4,171,553

[45] Oct. 23, 1979

[54] STALK VACUUM CLEANER

[76] Inventor: Klaus Stein, No. 12, Diesterwegstrasse, 5620 Velbert-Neviges 15, Fed. Rep. of Germany

[21] Appl. No.: 861,059

[22] Filed: Dec. 15, 1977

[30] Foreign Application Priority Data

Sep. 17, 1977 [DE] Fed. Rep. of Germany ..... 2741911

[51] Int. Cl.[2] ..... A47L 5/28

[52] U.S. Cl. ..... 15/350; 15/335

[58] Field of Search ..... 15/331, 334, 335, 336, 15/350, 323

[56] References Cited

U.S. PATENT DOCUMENTS

| | | | |
|---|---|---|---|
| 1,763,397 | 6/1930 | Hutchinson | 15/334 |
| 1,936,761 | 11/1933 | Hoover | 15/323 X |
| 2,175,647 | 10/1939 | Replogle | 15/335 |
| 2,266,075 | 12/1941 | Replogle | 15/335 |
| 2,343,056 | 2/1944 | Harlett | 15/331 X |
| 2,867,833 | 1/1959 | Duff | 15/337 X |
| 2,876,481 | 3/1959 | Gerber et al. | 15/331 |

*Primary Examiner*—Christopher K. Moore
*Attorney, Agent, or Firm*—John C. Smith, Jr.

[57] ABSTRACT

A stalk vacuum cleaner having a casing and an air-suction socket at the lower end portion of the casing, wherein the dirt is fed from the top to a dust bag arranged in the upper end portion of the casing of the stalk vacuum cleaner under the action of a suction system arranged at the lower end portion of the casing of the stalk vacuum cleaner by means of a riser tube. The riser tube is in the form of a movable hose constituting a fixed component of the casing of the vacuum cleaner. The lower end of the hose is detachably connected to the air-suction socket.

5 Claims, 5 Drawing Figures

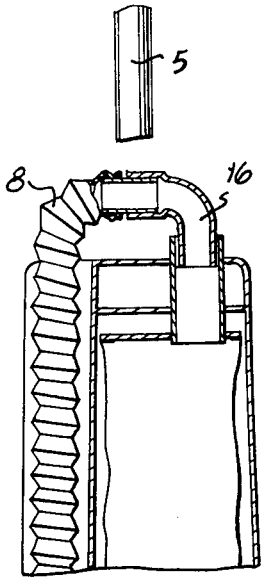
FIG. 4
FIG. 1
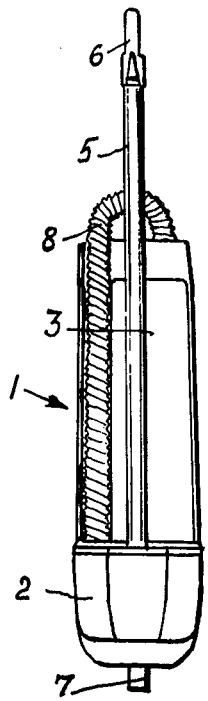
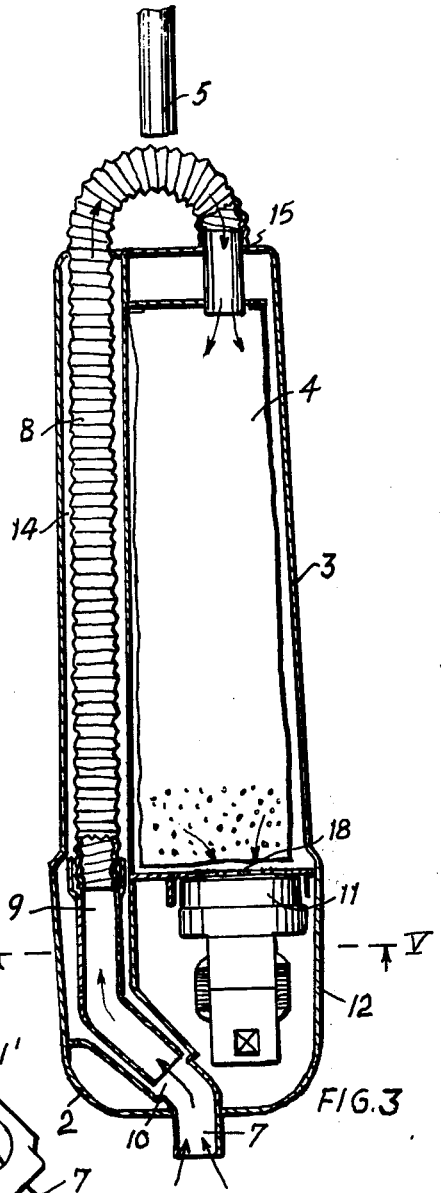
FIG. 3
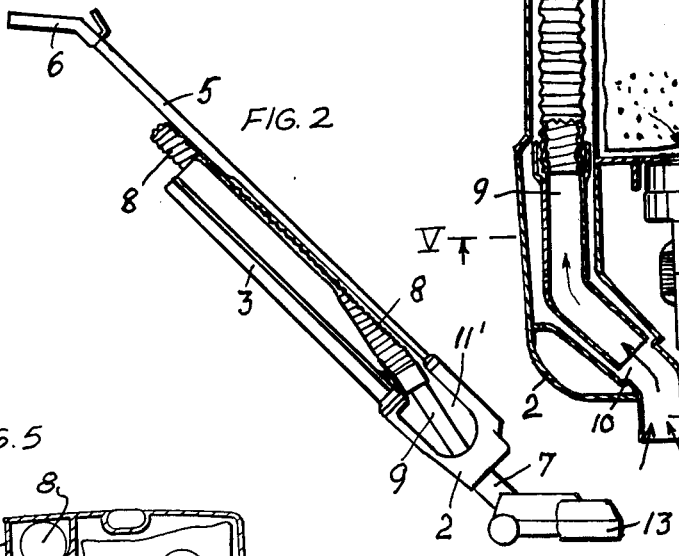
FIG. 2
FIG. 5
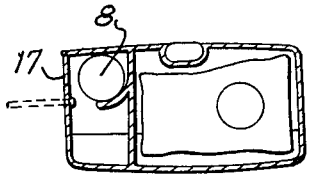

STALK VACUUM CLEANER

BACKGROUND OF THE INVENTION

This invention relates to a stalk vacuum cleaner, i.e. a vacuum cleaner including a casing containing a suction system and a dust bag, said casing on the one hand being manipulatable by hand by means of a stalk attached to the casing and on the other hand having a rigidly built-in air-suction socket at the lower end portion of the casing. To the suction system selectively special differently formed nozzles, but also further special suction attachments (sweeper, electrical polisher) may be connected rigidly or detachably.

Next to these stalk vacuum cleaners, the so-called floor vacuum cleaners are conventional, i.e. vacuum cleaners wherein the suction system and the filter means associated therewith are accommodated in a casing designed movable on the floor, at the rigidly built-in air-suction socket of said casing a movable suction hose being provided which also serves the purpose of pulling the casing from one place to the other. Such a movable hose offers the advantage that it permits various different uses of the vacuum cleaner next to the usual cleaning of the floor which is permitted by the suction hose movable in all directions, e.g. a convenient vacuum-cleaning of objects not located on the floor such as furniture, curtains, walls.

In order to obtain this advantage of versatile use also for the handy stalk vacuum cleaners, it is known to provide for them a loose, thus not permanently device-connected hose which is to be joined to the suction socket only upon requirement. Such an assembly generally is considered to be inconvenient because of complicatedness thereof and the subsequent often inferior handiness of the stalk vacuum cleaner; it is therefore mostly not done, when working only in between with the hose, e.g. in locations otherwise less accessible.

Therefore, stalk vacuum cleaners have also been introduced wherein at the casing a further suction opening is provided to which upon requirement a movable hose can be connected which is usable as suction hose only by switching over at least one valve. This solution also does not improve the handiness of the device.

Furthermore, the German Auslegeschrift No. 1,208,457 discloses a device which is designed as a floor vacuum cleaner and which has a suction nozzle located directly at the casing, said suction nozzle next to its downwardly directed mouthpiece opening having a second suction opening with a suction hose firmly connected to the device, when using the second suction opening the nozzle mouthpiece having to be closed relative to the second suction opening. When closing the mouthpiece opening (floor nozzle), a valve mechanism is to be operated, whereas for closing the suction hose the mouthpiece thereof is to be applied suckingly to the casing wall in using a rubber seal.

The foregoing proposals, however, have associated material disadvantages:

(a) for the two air paths to be kept separated (normal or with hose), a valve system for switching over the suction flow must be provided;

(b) since the air cross section in the suction path and the flow direction of the suction air change in most designs, a blocking of the suction path difficult to eliminate can readily occur;

(c) as a result of leaks at the joints and switching valves, losses occur in the event a high investment of seals is not made.

SUMMARY OF THE INVENTION

It is therefore the object of the present invention to avoid the disadvantages of the stalk vacuum cleaners known up to now and to provide a device wherein a switching over to a hose attached to the casing can be effected in a simple and therefore convenient fashion, but nevertheless with maximal operational reliability. The invention sets out from a conventional arrangement of a stalk vacuum cleaner wherein dirt is fed from the top to a dust bag of filter material under the action of a suction system arranged in the lower end portion of the casing by means of a riser tube a component of the casing and connected to the suction socket thereof.

To attain this object the present invention provides a stalk vacuum cleaner which comprises (a) a casing having an upper and a lower end portion, said upper end portion having an opening; (b) a detachable cover for closing said opening; (c) a filter box formed by the upper end portion of the casing; (d) a dust bag of filter material insertable into and removable from the filter box through said opening; (e) a motor head forming the lower end portion of the casing; (f) an air-suction socket sealingly extending through the bottom of the motor head and providing an outer end portion for the connection thereto of an additional appliance and an inner end portion embedded in the motor head; (g) a riser tube in the form of a movable air-suction hose secured by one of its ends to the cover of the casing and extending therethrough into the dust bag and detachably coupled by its other end to the inner end portion of the air-suction socket, and (h) means in the lower end portion of the casing for producing flow of air through said hose and said dust bag, said dust bag having an opening through which the air enters from above.

The advantage of the stalk vacuum cleaner according to this invention over all conventional devices of this type is that the suction hose permitting various uses of the stalk vacuum cleaner is a necessary component of the device which in normal operation, via the suction socket, serves as riser tube for the suction air, so that an additional component to be rendered usable in some way only upon requirement is not required any more.

BRIEF DESCRIPTION OF THE DRAWING

An embodiment of the invention will now be described by way of example and with reference to the accompanying drawing in which:

FIGS. 1 and 2 are front and side elevational views, respectively, of a stalk vacuum cleaner according to the invention;

FIG. 3 is a longitudinal sectional view of the stalk vacuum cleaner;

FIG. 4 is a partial longitudinal sectional view of another embodiment of the stalk vacuum cleaner; and FIG. 5 is a cross-sectional view taken along the line V—V of FIG. 3 illustrating a still further embodiment of the stalk vacuum cleaner.

DESCRIPTION OF THE PREFERRED EMBODIMENT

The drawings show a stalk vacuum cleaner which comprises a casing 1 containing partition means defining a lower chamber 2 containing a blower 11, an upper chamber or filter box 3 containing a dust bag 4 of filter material and an elongated channel or trough 14. At least one aperture 18 in the partition means between the upper and lower chambers provides communication therebetween. A stalk 5 including a handle 6 for guiding the vacuum cleaner is attached to the casing 1. At the lower end portion of the casing 1, i.e. of the channel 14, an air-suction socket 7 is provided which extends through the bottom of the casing so as to provide an outer end portion for connection of attachment devices and an inner end portion which is contained in the channel so as to permit a coupling with one end of a riser tube in the form of a flexible air-suction hose 8 provided with a handle 9.

The other end of the flexible suction hose 8 is arranged at the upper portion of the casing 1 and passes through an opening 15 into the filter box 3, whereas the said one end of the hose 8 which is provided with the handle 9 may pass through the channel 14 and is inserted into an opening 10 formed by the inner end portion of the air-suction socket 7 in the channel. The necessary air discharge openings 12 may be provided in the lower chamber. As shown in FIG. 2, e.g. an electrically operated attachment device 13, e.g. a sweeper, may be firmly connected to the suction socket 7.

Advantageously, the end of the hose 8 couplable to the air-suction socket 7 is designed in such a way that additional appliances such as differently shaped conventionally used nozzles are able to be attached to that end. When electrically operated attachment devices such as sweepers or polishers are attached to the suction socket 7, it is of an advantage to provide a switching device which upon withdrawing the hose end provided with the handle 9 from the suction socket switches off these appliances. Such a device may not be required when the hose 8 itself is provided with a current supply lead.

In order to permit a free movability of the hose 8 pulled out of the channel 14, the end of the hose 8 attached to the casing 1 and leading to the dust bag 4 may be connected to a rotary adapter 16 (FIG. 4), e.g. an elbow, at the insertion into the casing.

For accommodating the hose 8 at the casing, an elongated opening 11' may be provided thereat in which the hose 8 is openly disposed and the opening 10 is located; this opening 11' on the other hand may also be closed by a pivotable or removable cover 17 (FIG. 5). It is very important for as large an action radius as possible that the hose be sufficiently long, and this may be accomplished by using a highly extensible material such as a stretch hose.

The operation of the stalk vacuum cleaner of this invention is simple:

For normal vacuum cleaning with the suction socket 7 to which, if required, special nozzles or attachment appliances may be connected, the hose end with the handle 9 passes through the channel and is inserted in the opening 10 of the suction socket. The suction air then flows through the suction socket 7 and the hose 8 as well as the dust bag 4. The hose 8 thus is in full use also in this case of operation.

When now a vacuum cleaning is to be performed with the hose 8 directly, the end of the hose 8 provided with the handle 9 is withdrawn from the opening 10 of the suction socket 7 so that the now freely movable end of the hose may be used as, or connected to, a nozzle.

The invention may be embodied in other specific forms without departing from the spirit or essential characteristics thereof. The embodiment is therefore to be considered in all respects as illustrative and not restrictive.

What is claimed is:

1. A stalk vacuum cleaner comprising:

(a) an elongated casing comprising partition means defining an elongated channel extending from the top of said casing to a position spaced from the bottom of said casing and at least one chamber adjacent said channel, the top end of said channel being open and the bottom end thereof being closed by said partition means;

(b) a tubular air-suction socket integral with said casing and extending from the bottom end of said channel through said partition means, the lower end of said air-suction socket being adapted for connection to an attachment;

(c) a first opening in the top of said casing communicating with said chamber;

(d) a blower for drawing an air stream along a path through said first opening and chamber;

(e) air filter means in said path between said first opening and said blower for removing dust particles from said air stream; and (f) a flexible hose, one end thereof being connected to said first opening and the free end thereof being adapted for connection to at least one attachment or alternatively for connection to the upper end of said air suction socket with said flexible hose extending from said opening through said channel from said top end thereof;

(g) the portion of said casing defining the portion of said channel adjacent the bottom end of said channel having a second opening for access to the upper end of said air-suction socket for grasping said free end of said hose to connect and disconnect said free end of said hose to and from said upper end of said air-suction socket;

(h) whereby said hose is substantially contained within said casing when said attachment connected to said air-suction socket is in use.

2. A stalk vacuum cleaner according to claim 1 wherein the free end of said flexible hose is formed as a handle.

3. A stalk vacuum cleaner according to claim 1 wherein said first opening communicating with said upper chamber includes an intermediate rotary member, said one end of said flexible hose being secured to said intermediate member such that said flexible hose is rotatable.

4. A stalk vacuum cleaner according to claim 1 further comprising a removable cover for said second opening in said casing.

5. A stalk vacuum cleaner according to claim 1 wherein said flexible hose is extensible in length.

* * * * *